United States Patent [19]

Gibson

[11] 3,997,950

[45] Dec. 21, 1976

[54] METHOD OF TREATING LARGE DIAMETER YARNS TO PROVIDE BULKING DYED AND/OR MOTTLED EFFECTS IN FABRIC

[75] Inventor: Kirkland H. Gibson, North Kingstown, R.I.

[73] Assignee: H. G. P. Corporation, Johnston, R.I.

[22] Filed: May 9, 1975

[21] Appl. No.: 576,190

[52] U.S. Cl. ..... 28/72.16; 28/75 WT

[51] Int. Cl.[2] ..... D04B 19/00

[58] Field of Search ..... 28/72.16, 74 R, 75 WT; 139/383

[56] References Cited

UNITED STATES PATENTS 3,605,225 9/1971 Gibson et al. ..... 28/72.16

*Primary Examiner*—Louis K. Rimrodt

*Attorney, Agent, or Firm*—Barlow & Barlow

[57] ABSTRACT

The method of treating large diameter yarns by leasing a plurality of large diameter filling yarns into a woven fabric form of a type where the warp yarns are relatively small, and in which the filling yarn may be easily unwoven, treating the filling yarn either by means of a color, or bulking, or both of them and then unweaving the woven fabric to provide a treated yarn for reworking into various forms such as fabrics and carpets and the like.

4 Claims, 5 Drawing Figures

METHOD OF TREATING LARGE DIAMETER YARNS TO PROVIDE BULKING DYED AND/OR MOTTLED EFFECTS IN FABRIC

BACKGROUND OF THE INVENTION

To produce dyed yarns, the so-called prefabrics have been knitted by the manipulation of a single yarn into knitted form variously colored and then unraveled to provide a single yarn with intermittent coloring or splotches as shown in U.S. Pat. No. 3,012,303 dated Dec. 12, 1961. In another process, continuous yarn is leased in a narrow fabric form and has been treated as disclosed in U.S. Pat. No. 3,605,225. In this patent, the warp yarns are heavier or of greater diameter than the filling yarns.

SUMMARY OF THE INVENTION

This invention utilizes the weaving of a plurality of relatively small diameter warp yarns into a fabric by the insertion of a relatively large diameter filling yarn in the warp yarns in such a relation that the filling may be easily unraveled or unwoven and further the yarns may be loosely woven or the filling yarn may be varied as to the picks per inch or its diametrical size depending upon the desired result. The fabric so formed may be heat treated to bulk it and to set the bulk or to color it either by a solid color or by stripes or splotches after which unraveling takes place to remove the treated filling from the warp and provide a yarn for reworking into various forms such as a fabric where bulking dyed or mottled colors or both of them are desired.

DESCRIPTION OF THE PREFERRED EMBODIMENT

With reference to the drawings, 10 designates generally a supply of warp yarns from various warp beams. 11 designates the station of weaving these warp yarns by inserting a filling therein in a particular relation to be described so as to provide a fabric 12 which issues from this weaving station. If desired, the fabric is wound and is then unwound and passed to the coloring station 13 wherein a dye is applied to the fabric 12 as it passes therethrough. The fabric now designated 12' may again be wound or otherwise held and is then passed into a bulking station 14 where heat is applied to relax or bulk the yarn particularly the untensioned filling yarn and set the bulk in the filling yarns while in their weaving relation with the warp yarns which, becuase of their size, can be thought of as threads. The fabric now at 12'' is moved into a station 15 where the filling yarn is removed for reworking and then the warp yarns are packaged as at 16 for reuse as desired.

Figure 1:
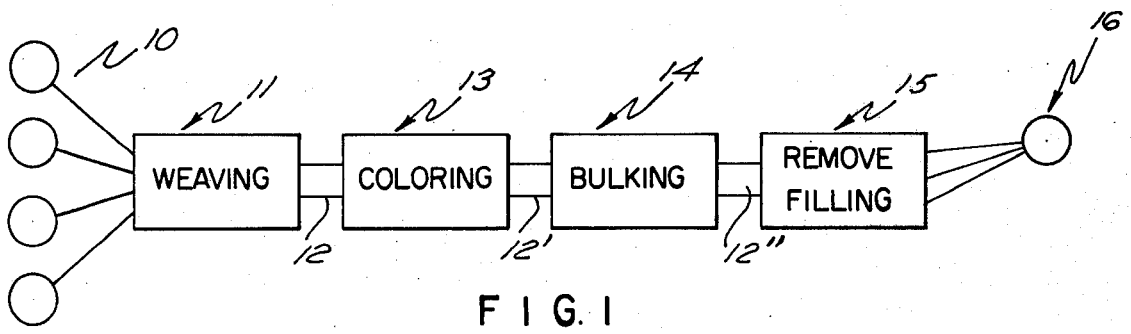
FIG. 1 is a diagrammatic view illustrating the various steps which are performed upon the yarns which are the subject of this invention.
Figure 2:
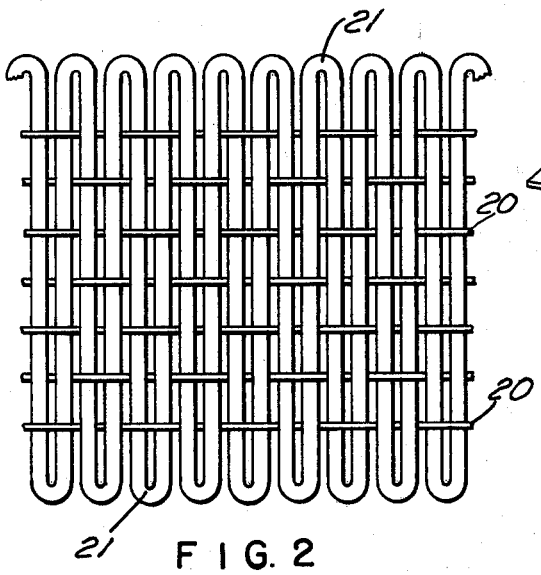
FIG. 2 is a detail plan on a greatly enlarged scale illustrating the weaving relation of the filling and warp yarns so that the filling yarn may be easily withdrawn by pulling upon it to remove it from the warp yarns.

At the weaving station 11 the plurality of warp yarns 20 (diagrammatic showing FIG. 2 in a greatly reduced number of warp ends) are shown in the greatly enlarged relation in FIG. 2 where they are separated sufficiently so that the relationship of the filling yarn 21 may be observed. The insertion of the relatively large diameter filling yarns 21 is shown as by means of a double pick needle loom where pick goes acorss the width of the fabric and back before the shed changes. In this manner the filling is laid in with little or no tension and such tension as exists in the fabric is carried by the warp yarns. This is highly desirable for bulking of the filling yarns.

The filling yarns 21 are inserted so as to be substantially in contact with each other across the width of the woven fabric. The number of filling threads per inch of warp length of the fabric will be determined by the diameter of the filling yarn. Thus if the diameter of the filling yarn is one tenth of an inch (0.1 inch) (0.25 cm) there will be approximately 10 filling picks or yarns per inch of length of the warp yarns, (4 picks per cm) bulking of the filling varying this figure. It will be obvious that many weave constructions may be used, the one up one down illustrated in FIG. 2 being purely exemplary, other selected fabric constructions being usable.

Figure 3:
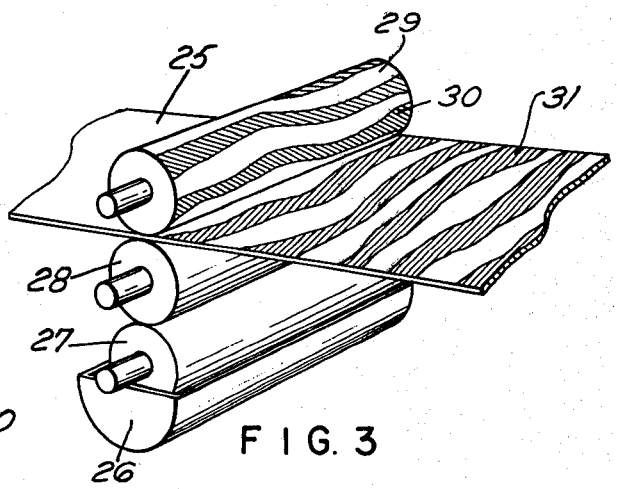
FIG. 3 is a perspective view illustrating the intermittent coloring of the fabric formed.

After the insertion of the filling threads 21, the fabric now designated 25 (FIG. 2) is passed through one or a plurality of printing or padding stations, one of which is shown. Each may apply its own color to the fabric. A part of a Vigoureux printer is illustrated in FIG. 3 which includes a dye trough 26, a first lower partly immersed dye pick-up roller 27, a second upper pick-up and application roller 28, and a printing roller 29, the latter being on the upper side of the fabric 25. The lower roller 27 picks up dye from the trough 26, transferring it to the upper pick-up roller 28. The printing roller 29 has a plurality of raised portions 30 thereon, and as these press the fabric into engagement with the roller 28, the dye will be applied at the locations where this pressure of the raised portion 30 occurs, thus forming a plurality of stripes 31, in the showing here, across on the fabric 25 as it passes thru this printer or padder. At other stations similar to this, different colors may be applied.

After this coloring, when the warp threads are in a wavy form, it is passed into a station 14 where heat and pressure are applied. This will drive the dye into the fabric and particularly the filling yarns thereof, while at the same time if the fabric is loosely woven it will permit relaxation of the yarns causing them to increase in diameter or bulk. Also the heat will assist in bulking the yarn.

Figure 4:
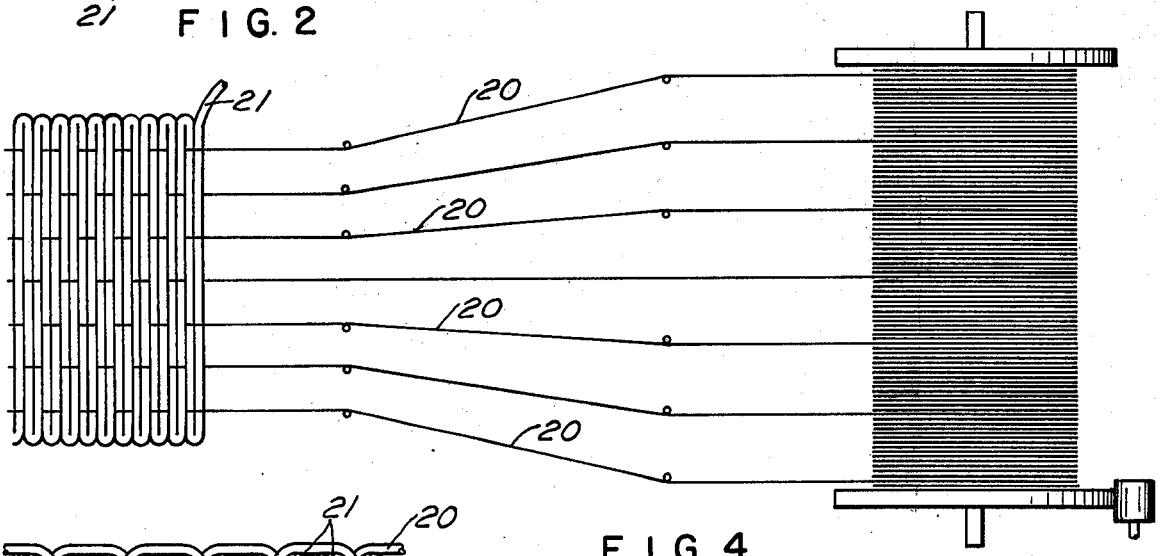
FIG. 4 is a top plan view on an enlarged scale showing the removing of the filling yarn from the warp yarns which are spread in separated relation for takeup on a beam.
Figure 5:
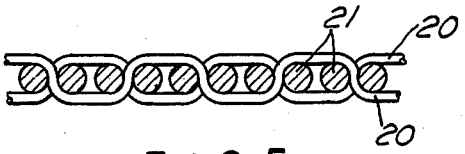
FIG. 5 is a sectional view taken warpwise of the fabric.

The next station 15 is where the filling yarn 21 is removed from the warp threads 20 as shown at FIG. 4 and this may be done by unraveling the filling yarns 21 from the warp threads by pulling upon it with any suitable means and a take-up, thus leaving the warp threads 20 in a separated relation to be packaged for reuse if desired.

By leasing warp yarns, bulking of the filling yarns is facilitated and a very close control may be had of the application of the color to the filling yarns. Further a plurality of yarns are provided which, from the process employed, may be of endless length depending upon the supply on the warp beam. Further there is really no theoretical limit to the length of filling yarn which may be operated upon at the same time. Practically the only limit is the width of the machine which weaves the filling yarn into the warp threads. The process is far more precise than may be had by a knitting-deknitting method such as disclosed in the above "Background of the Invention" and more bulking of the filling yarns may be provided.

I claim:

1. An improved method of treating yarn which comprises providing a plurality of relatively small diameter warp yarns, weaving in a selected fabric construction, said warp yarns under tension with a filling yarn of a relatively larger diameter than the warp yarns disposed with relation to the warp yarns in a relatively untensioned continuous unravelable relation and treating said fabric to treat the filling yarns and unraveling said filling yarn to provide a treated yarn for reworking into various forms.

2. The method of treating yarn as in claim 1 wherein the step of treating includes the step of coloring the fabric.

3. The improved method of treating yarn which comprises providing a plurality of relatively small diameter warp yarns, weaving in a selected fabric construction said warp yarns under tension with a filling yarn of a relatively larger diameter than the warp yarns disposed with relation to the warp yarns in a relatively untensioned continuous unravelable relation and heating said fabric to allow the filling yarns to bulk and unraveling said filling yarn to provide a yarn of increased bulk for reworking into various forms.

4. The method of treating yarn as in claim 3 including the step of coloring the fabric after weaving.

* * * * *